US005847364A

United States Patent [19]

White et al.

[11] Patent Number: 5,847,364

[45] Date of Patent: Dec. 8, 1998

[54] RADIANT HEATER SUPPORT SYSTEM

[75] Inventors: James Aaron White; Michael Stephen Woods, both of Louisville, Ky.

[73] Assignee: General Electric Company, Louisville, Ky.

[21] Appl. No.: 825,930

[22] Filed: Apr. 7, 1997

[51] Int. Cl.[6] ..... H05B 3/68

[52] U.S. Cl. ..... 219/464; 219/463

[58] Field of Search ..... 219/458, 463, 219/464, 465, 466, 467; 126/211, 214 A, 212, 220, 92 A, 39 H, 39 B

[56] References Cited

U.S. PATENT DOCUMENTS

| | | | |
|---|---|---|---|
| 2,727,133 | 12/1955 | Scofield | 219/464 |
| 3,613,177 | 10/1971 | Davis . | |
| 3,632,983 | 1/1972 | Dills . | |
| 3,789,189 | 1/1974 | Fischer et al. . | |
| 3,987,275 | 10/1976 | Hurko . | |
| 4,032,750 | 6/1977 | Hurko . | |
| 4,150,280 | 4/1979 | Hurko . | |
| 4,264,805 | 4/1981 | Traut . | |
| 4,363,956 | 12/1982 | Scheidler et al. . | |
| 4,453,533 | 6/1984 | Scheidler et al. | 219/464 |
| 4,778,978 | 10/1988 | Schreder et al. . | |
| 4,788,414 | 11/1988 | Schreder . | |
| 4,900,899 | 2/1990 | Schreder et al. . | |
| 5,429,114 | 7/1995 | Taplan et al. | 219/464 |
| 5,571,434 | 11/1996 | Cavener et al. | 219/464 |

*Primary Examiner*—Teresa J. Walberg
*Assistant Examiner*—Sam Paik
*Attorney, Agent, or Firm*—H. Neil Houser

[57] ABSTRACT

Ranges which include mounting systems for securing the heating elements so that the heating elements are maintained against an underside surface of the glass plate with a substantially constant force over a broad temperature range are described. In one embodiment, the cooktop includes a frame and a support panel having a plurality of radiant heating element openings. A glass panel is adhesively secured at selected locations to the support panel. The mounting system includes coil springs for engaging to the support panel and to the radiant heating elements for positioning the radiant heating elements within the radiant heating element openings and against the glass plate.

15 Claims, 1 Drawing Sheet

RADIANT HEATER SUPPORT SYSTEM

FIELD OF THE INVENTION

This invention relates generally to ranges including radiant cooktop heating elements and, more particularly, to a mounting system for supporting the heating elements.

BACKGROUND OF THE INVENTION

In at least some known radiant cooktop ranges, the heating elements are secured to the cooktop below a cooktop glass plate. The heating elements are held against the cooktop glass plate by a mounting assembly including a bracket secured to the cooktop and a brace which extends the width of the cooktop. The heating elements are mounted to the brace by a compression coil spring and stud assembly. The compression coil spring and stud assembly provides that the heating elements are forced against the cooktop glass plate with a desired force so that heat from the heater elements is efficiently transferred through the glass plate. In operation, as the heating element heats up, the heat is transferred through the cooktop glass plate to, for example, a cooking bowl located over the heating element on the glass plate.

Although the known mounting assembly described above adequately locates and supports the radiant heating elements, such assembly includes numerous parts and is complex to assemble. As a result, assembling the heating elements in the range is time consuming and tedious, which is particularly undesirable in a high volume manufacturing operation.

In addition, and to assemble the mounting assembly described above, tools are used for mounting the bracket to the cooktop, securing the braces to the bracket, and engaging the spring and stud assemblies to the braces and heating elements. The cooktop glass plate, however, is susceptible to scratching, and when using the tools for assembling the mounting assembly, there is a possibility that the glass plate will be scratched by a tool. Of course, scratching the glass plate is highly undesirable since such a scratched plate typically will break during shipment.

It would be desirable to provide a mounting system for mounting heating elements to cooktops so that over a wide range of operating temperatures, the heating elements are forced against the cooktop glass plate with a desired force, e.g., fourteen pounds. In addition, it would be desirable for such a system to have a reduced number of parts as compared to known mounting assemblies and be simple to assemble. Further, it would be desirable to substantially eliminate a need for the use of tools to secure the heating element to the cooktop so as to facilitate avoiding scratching the glass cooktop.

SUMMARY OF THE INVENTION

These and other objects may be attained in a range which includes a mounting system for securing the heating elements to the range so that the heating elements are maintained against an underside surface of the glass plate with a substantially constant force over a broad temperature range. In one embodiment, the cooktop includes a frame and a center support panel having a plurality of radiant heating element openings. A glass plate is adhesively secured at selected locations to the support panel as described below. The mounting system includes coil springs or other type springs for engaging to the center support panel and to the radiant heating elements for positioning the radiant heating elements within the radiant heating element openings and against the glass plate.

More particularly, and for each heating element opening, a rim extends from an underside surface of the support panel and surrounds the radiant heating element opening. The rim includes a first slot and a second slot, and the first and second slots are located approximately about one hundred and eighty degrees apart in the rim. The first coil spring has a spring hook portion at least partially inserted into the first rim slot, and the second coil spring includes a spring hook portion at least partially inserted into the second rim slot. Each coil spring also includes a lead-in portion for engaging to the heating element. Specifically, the coil spring lead-in portion can be inserting into a opening in the heating element.

To install the coil springs, each spring is positioned so that the respective spring hooks extends through respective rim slots. Each spring is then oriented so that its lead-in portion is inserted into the opening in the heating element. The spring coils exert an upward force on the heating element so that the heating element is forced against the glass plate with the desired force.

With respect to the location of the adhesive between the glass plate and the cooktop, the adhesive is located, for example, proximate the edges of the glass plate. In addition, adhesive is located approximately about at the center of the support panel. By locating the adhesive at about the center of the support panel, and in addition to provided added strength for supporting the heating elements, the adhesive facilitates maintaining the correct spacing between the glass plate and the support panel of the cooktop.

The above described mounting system secures the heating elements within the range by utilizing the glass plate for stability and support. The added stability and support provided by the glass plate facilitates maintaining the heating elements against the panel with a desired force, e.g., fourteen pounds.

In addition, the system has a reduced number of parts as compared to known mounting assemblies and is simple to assemble. Further, the system substantially eliminates a need for the use of tools to secure the heating elements so as to facilitate avoiding scratching the glass plate.

DETAILED DESCRIPTION OF THE DRAWINGS

Figure 1:
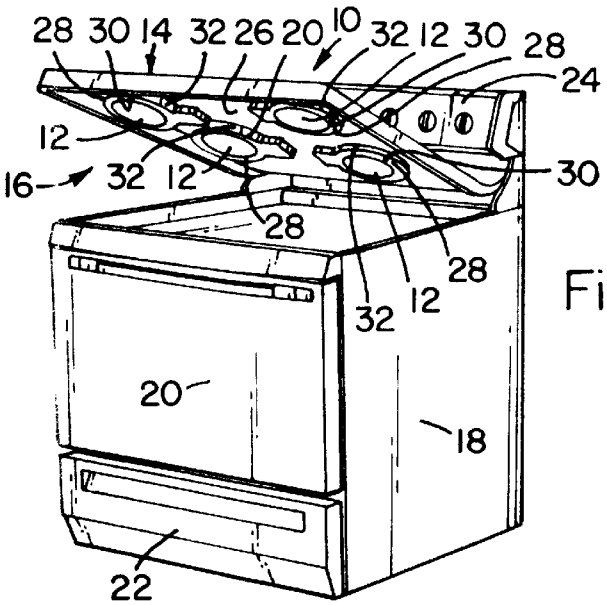
FIG. 1 is a perspective view of a range including radiant heating elements and a mounting system in accordance with one embodiment of the present invention.

FIG. 1 is a perspective view of a radiant cooktop range 10 including heating elements 12 secured to a cooktop 14 by a mounting system 16 in accordance with one embodiment of the present invention. Range 10 includes a cabinet 18, a door 20 closing an open end of a cooking cavity (not shown) and secured (e.g., by hinges) to cabinet 18, and a lower drawer 22. Range 10 further includes a backsplash 24 extending from cabinet 18.

As described hereinafter in more detail, cooktop 14, in one embodiment, includes a support panel 26 having a plurality of openings 28 for receiving radiant heating elements 12. Panel 26 can be formed as an integral component of cooktop 14 or as a separate component. A plurality of coil springs 30 are secured to rims 32 which extend from an underside of support panel 26 at the location of openings 28, and each rim 32 substantially surrounds a respective one of openings 28. For each rim 32, springs 30 are secured approximately about one hundred and eighty degrees apart to rim 32 and support heating element 12.

Mounting system 16 can be utilized in many different model ranges and is not limited to use in any one particular range. Range 10 is illustrated here by way of example only. Ranges 10 are well known and are commercially available from General Electric Company, Appliance Park, Louisville, Ky. 40225.

Figure 2:
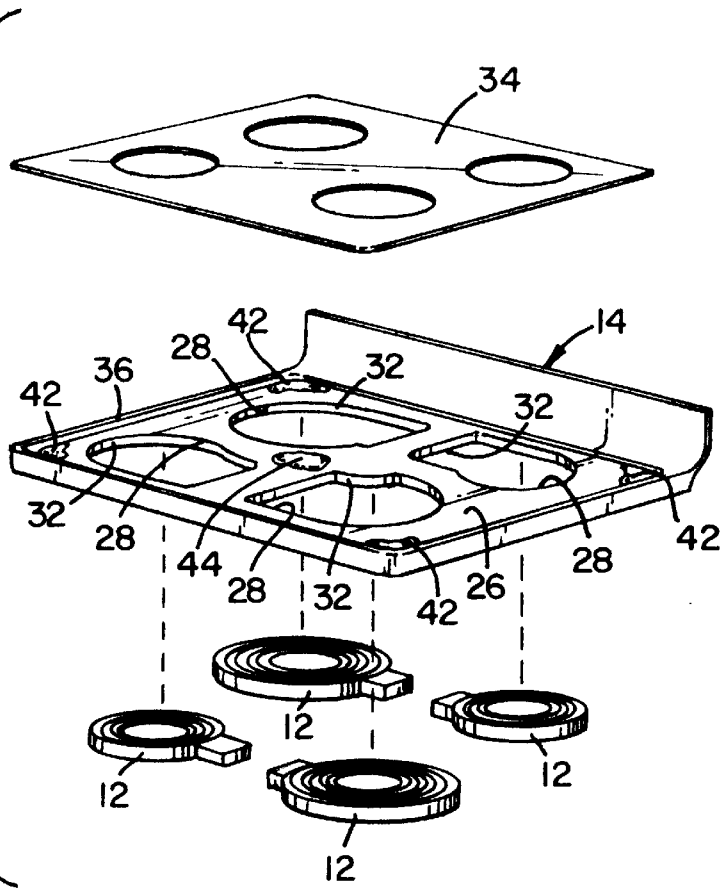
FIG. 2 is an exploded view of the cooktop and heating element assembly shown in FIG. 1.

FIG. 2 is an exploded view of a glass plate 34, cooktop 14 and mounting assembly 16. As shown in FIG. 2, cooktop 14 includes a frame 36 and support panel 26. Panel 26 includes a plurality of radiant heating element openings 28, and glass plate 34 is adhesively secured at selected locations 42 to plate 26. Plate 34 can be secured to plate 26 using, for example, a silicone adhesive or other adhesive material.

More specifically, and with respect to the location of the adhesive, the adhesive is located, for example, proximate the edges of glass plate 34 at location 42. In addition, the adhesive is located approximately about at the center of support panel 26 at location 44. By locating the adhesive at about the center of support panel 26, and in addition to provided added strength for supporting heating elements 12, the adhesive facilitates maintaining the correct spacing between glass plate 34 and support panel 26 of cooktop 14.

In addition, and surprisingly, by locating adhesive at about the center of support panel 26, less glass breakage is likely to occur. The result is surprising because known art teaches that by locating adhesive at the center location between glass plate 34 and support panel 26, the flexibility of glass plate 34 will be decreased thereby resulting in breaking of glass plate 34. It has been found, however, that by locating adhesive at center location 44 between glass plate 34 and support panel 26, not only is additional strength provided for supporting heating elements 12, but actually less glass breakage is likely to result.

Without the adhesive located at about the center of support panel 26, due to the force of spring 30, panel 26 would be pulled away from glass plate 34 at center location 44 and the spacing between glass plate 34 and support panel 26 would be increased at location 44 as compared, for example, to such spacing at the edges of glass plate 34. Maintaining a substantially uniform spacing between glass plate 34 and support panel 26 is desirable to facilitate maintaining heating elements 12 against glass plate 34 with the desired amount of force. Therefore, in addition to reducing the likelihood of breaking glass plate 34, by applying adhesive at location 44, the desired spacing between support panel 26 and glass plate 34 is maintained, which provides that heating elements 12 are forced against glass plate 34 with the desired force.

Figure 3:
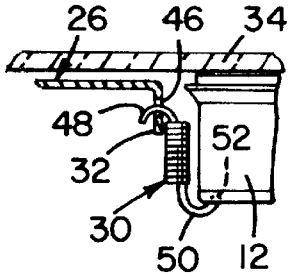
FIG. 3 is an enlarged, partial cross sectional view illustrating the coil spring for securing the heating element to the glass panel.

FIG. 3 is an enlarged, partial cross sectional view illustrating one coil spring 30 securing heating element 12 against glass plate 34. Particularly, rim 32 includes slot 46. Another slot (not shown) is located approximately about one hundred and eighty degrees apart in rim 32. Coil spring 30 has a spring hook portion 48 at least partially inserted into rim slot 46 and a lead-in portion 50 engages to heating element 12. Specifically, coil spring lead-in portion 50 is inserted into an opening 52 in heating element 12. Typically, two coil springs 30 are utilized to secure each heating element 12, although more springs 30 could be used, if desired.

To install coil springs 30, each spring 30 is positioned so that its respective spring hook 48 extends through one of respective rim slots 46. Spring 30 is then oriented so that its lead-in portion 50 is inserted into one of openings 52 in heating element 12. Spring coil 30 exerts an upward force on heating element 12 so that heating element 12 is forced against glass plate 34 with the desired force. Hook portion 48 may be spaced from heating element 12, for example, so that cooling air can flow between hook portion 48 and element 12.

Figure 4:
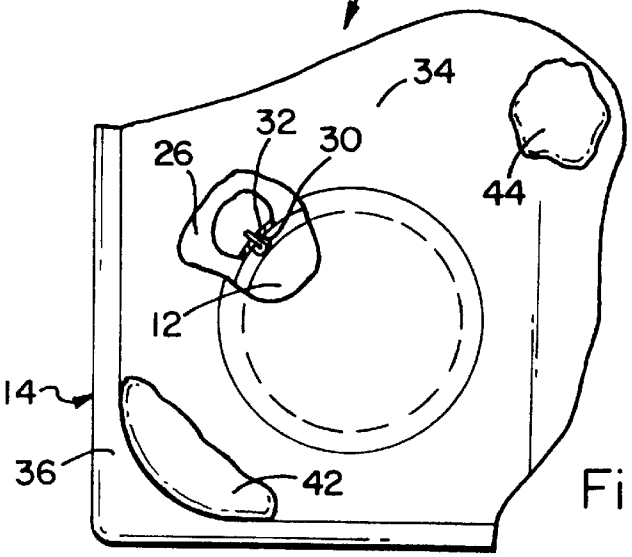
FIG. 4 is a partial top view, with components cut-away, of the range shown in FIG. 1.

FIG. 4 is a partial top view, with components cut-away, of range 10. As shown in FIG. 4, glass plate 34 is secured to support panel 26 at various locations 42 and 44. By so securing glass plate 34 to support panel 26, glass plate 34 provides stability and support for heating elements 12. The added stability and support provided by glass plate 34 facilitates maintaining heating elements 12 against glass plate 34 with a desired force, e.g., fourteen pounds.

It also is believed that by securing glass plate 34 to support panel 26, glass plate 34 is subjected to only low stresses, which results in the dome of plate 34 being less than domes associated with known ranges. More particularly, the term "dome" refers to the shape of known glass panels and results in skillets not being able to be entirely level when resting on the glass panel. By lowering the dome of plate 34, skillets and other cooking pots are more level when resting on plate 34, which facilitates maintaining such pots on glass plate 34 while cooking.

In addition, mounting system 16 has a reduced number of parts as compared to known mounting assemblies and is simple to assemble. Further, system 16 substantially eliminates a need for the use of tools to secure heating elements so as to facilitate avoiding scratching glass panel.

From the preceding description of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A range comprising:

a cooktop comprising a frame and a support panel having at least one radiant heating element opening and a rim extending from an underside surface of said support panel surrounding said radiant heating element opening;

a glass plate located over said support panel and adhesively secured to said support panel at least at approximately about a center location of said support panel;

a radiant heating element; and a mounting system comprising a spring for engaging to said rim and to said radiant heating element for positioning said radiant heating element within said radiant heating element opening.

2. A range in accordance with claim 1 wherein said rim comprises at least one slot, and said spring comprises a spring hook portion at least partially inserted into said rim slot.

3. A range in accordance with claim 1 wherein said spring comprises a lead-in portion for engaging to said heating element.

4. A range in accordance with claim 1 wherein said mounting system forces said heating element against an underside surface of said glass plate.

5. A range in accordance with claim 4 wherein a force between said heating element and said glass plate is approximately about fourteen pounds.

6. A range in accordance with claim 1 wherein said glass plate is secured to said panel by a silicone adhesive.

7. A range in accordance with claim 1 wherein said support panel is adhesively secured to said glass plate at edges of said glass plate.

8. A range comprising:

a cooktop comprising a frame and a support panel having at least one radiant heating element opening and a rim extending from an underside surface of said support panel surrounding said radiant heating element opening; and a glass plate located over said support panel and adhesively secured to said support panel at least at approximately about a center location of said support panel.

9. A range in accordance with claim 8 further comprising a radiant heating element, and a spring engaged to said rim and to said radiant heating element for positioning said radiant heating element within said radiant heating element opening.

10. A range in accordance with claim 9 wherein said rim comprises at least one slot, and said spring comprises a spring hook portion at least partially inserted into said rim slot.

11. A range in accordance with claim 10 wherein said spring comprises a lead-in portion for engaging to said heating element.

12. A range in accordance with claim 9 wherein said heating element is forced against an underside surface of said glass plate.

13. A range in accordance with claim 12 wherein a force between said heating element and said glass plate is approximately about fourteen pounds.

14. A range in accordance with claim 8 wherein said glass plate is secured to said panel by a silicone adhesive.

15. A range in accordance with claim 8 wherein said support panel is adhesively secured to said glass plate at edges of said glass plate.

* * * * *